US006054803A

United States Patent [19]

Saita

[11] Patent Number: 6,054,803

[45] Date of Patent: Apr. 25, 2000

[54] COLOR SELECTING MECHANISM FOR A CRT HAVING SPECIFIED APERTURE SLIT DIMENSIONAL RELATIONSHIPS IN ORDER TO DAMPEN VIBRATIONS

[75] Inventor: Koji Saita, Kanagawa, Japan

[73] Assignee: Sony Corporation, Japan

[21] Appl. No.: 09/059,419

[22] Filed: Apr. 14, 1998

[30] Foreign Application Priority Data

Apr. 23, 1997 [JP] Japan ..... 9-106153

[51] Int. Cl.[7] ..... H01J 29/80; H01J 1/18; H01J 19/12

[52] U.S. Cl. ..... 313/402; 313/403; 313/407; 313/269

[58] Field of Search ..... 313/402, 403, 313/407, 408, 461, 477 R, 482, 269

[56] References Cited

U.S. PATENT DOCUMENTS

| | | | |
|---|---|---|---|
| 4,857,027 | 8/1989 | Makita et al. . | |
| 5,369,330 | 11/1994 | Aibara | 313/402 |
| 5,382,871 | 1/1995 | Funahashi et al. | 313/402 |
| 5,391,957 | 2/1995 | Fendley | 313/269 X |
| 5,394,051 | 2/1995 | Lerner | 313/269 X |
| 5,406,168 | 4/1995 | Takagi | 313/402 |
| 5,525,859 | 6/1996 | Ito et al. | 313/402 |

FOREIGN PATENT DOCUMENTS 07296739 11/1995 Japan .

*Primary Examiner*—Vip Patel
*Assistant Examiner*—Mack Haynes
*Attorney, Agent, or Firm*—Ronald P. Kananen; Rader, Fishman & Grauer

[57] ABSTRACT

It is possible to improve a vibration-proof band shaped grid element in a color selecting mechanism. In a color selecting mechanism 1 for a color cathode ray tube, in which a color selecting electrode thin plate (10) having a number of band shaped grid elements (8) and a slit shaped electron beam penetrating aperture (9) formed between respective neighboring grid elements (8), is seam-welded on a frame (6), the ratio of a length a of the above mentioned slit shaped electron beam aperture (9) to a distance (b) from an end portion of the above mentioned electron beam penetrating aperture (9) to a seam-welded orbit (17) or b/a×100 is set equal to or less than 2.5 percent.

2 Claims, 5 Drawing Sheets

COLOR SELECTING MECHANISM FOR A CRT HAVING SPECIFIED APERTURE SLIT DIMENSIONAL RELATIONSHIPS IN ORDER TO DAMPEN VIBRATIONS

BACKGROUND

1. Field of the Invention

The present invention relates to a color selecting mechanism used for a color cathode ray tube.

2. Background of the Invention

As a color selecting mechanism for a color cathode ray tube, for example, as shown in FIG. 1 and FIG. 2 (enlarged view of an essential portion), a color selecting mechanism 31 called an aperture grill is known. The color selecting mechanism 31 is provided with a frame-like metal frame 36 formed of a pair of supporting members 32 and 33 opposing each other and elasticity applying members 34 and 35 which are stretched between both end portions of the supporting members 32 and 33, and a mask member, that is, a color selecting electrode thin plate 40 in which a number of vertical slit shaped electron beam penetrating apertures 39 are arranged in one direction, that is, along a horizontal direction of a picture screen stretched between the opposing supporting members 32 and 33 on the frame 36.

The color selecting electrode thin plate 40 is made of a thin metal plate which is structured by arranging a number of thin band shaped grid elements 38 in the above mentioned one direction at a predetermined pitch, and by forming a long slit shaped electron beam penetrating 39 in a vertical direction of the picture screen between the respective neighboring grid elements 38 and in which the grid elements 38 are stretched between the supporting members 32 and 33 with a predetermined tension by the elasticity applying members 34 and 35. The color selecting electrode thin plate 40 is fixed onto the opposing supporting members 32 and 33 of the frame 36 by means of seam-welding. In FIG. 2, reference numeral 47 shows an orbit of the seam-welding.

In the color selecting mechanism 31, in order to prevent the grid elements 38 from vibrating, a damper wire 42 is stretched along an arranging direction of the grid elements 38 in contact with a surface of the color selecting electrode thin plate 40. The damper wire 42 is stretched through damper springs 44 fixed respectively onto the opposing elasticity applying members 34 and 35 of the frame 36.

Reference numeral 45 shows a supporting spring for fixing the color selecting mechanism 31 to a panel of a color cathode ray tube. The supporting spring 45 is welded on four sides of, for example, the supporting members 32 and 33, and the elasticity applying members 34 and 35 through a spring holder 43.

By the way, in the above color selecting mechanism 31, when it is applied with a vibration, the attenuation of the grid element 38 at a portion corresponding to a center of the picture screen is very slow. Therefore, in the color cathode ray tube equipped with the above mentioned color selecting mechanism 31, at a time of being applied with the vibration, there has occurred a change in brightness called a uniformity deterioration, thereby causing a problem.

Meanwhile, in the color selecting mechanism 31, as mentioned above, a plurality of the damper wires 42 are stretched along the surface of the color selecting electrode thin plate 40 in order to prevent the above-mentioned vibration, so shadows of the damper wires 42, that is, so-called damper shadows occur in the picture screen. Particularly, in a cathode ray tube of a fine pitch, that is, high definition, the damper shadows are conspicuous.

SUMMARY OF THE INVENTION

The present invention is to propose an excellent vibration-proof color selecting mechanism for a color cathode ray tub in view of the above mentioned points.

The inventor of the present invention, as a consequence of researches to solve the above mentioned problems, has found that reducing of a distance between an end portion of an electron beam penetrating aperture and a seam welding orbit (a width of a so-called periphery portion) of a color selecting mechanism, that is, decreasing a ratio of $b/a \times 100$; a being a length of the slit shaped electron beam penetrating aperture and b being a distance from the end portion of the electron beam penetrating aperture to the seam welding orbit, is most effective against a vibration of the grid element at the central portion. The present invention has been accomplished based on this finding.

Specifically, according to the present invention, the color selecting mechanism for a color cathode ray tube is so structured so that the ratio between the length a of the electron beam penetrating aperture and the distance b to the seam welding orbit from the end portion of the electron beam penetrating aperture, that is, $b/a \times 100$ is set equal to or less than 2.5 percent.

In the color selecting mechanism with such a structure according to the present invention, even if it is applied with the vibration, the attenuation of the vibration of the grid element at the central portion becomes faster, thereby leading to improvement of the vibration-proof of the grid element. In addition, because it becomes possible to install the damper wires outside an effective picture screen area, a color picture without any damper shadows can be obtained.

DESCRIPTION OF THE PREFERRED EMBODIMENT

A color selecting mechanism for a color cathode ray tube according to the present invention is, in a color selecting electrode in which a color selecting electrode thin plate having a number of band shaped grid elements and a slit shaped electron beam penetrating aperture formed between respective neighboring grid elements, is seam-welded on a frame, a ratio of a length a of the slit shaped electron beam penetrating aperture and a distance b to a seam welding orbit from an end portion of the electron beam penetrating aperture, that is, $b/a \times 100$ is set equal to or less than 2.5 percent.

The above mentioned color selecting mechanism for the color cathode ray tube according to the present invention is so structured that a damper wire is provided on a portion outside an effective picture screen area of a color selecting electrode thin plate.

Hereafter, one example of the color selecting mechanism for the color cathode ray tube according to the present invention will be described with reference to drawings.

Figure 3:
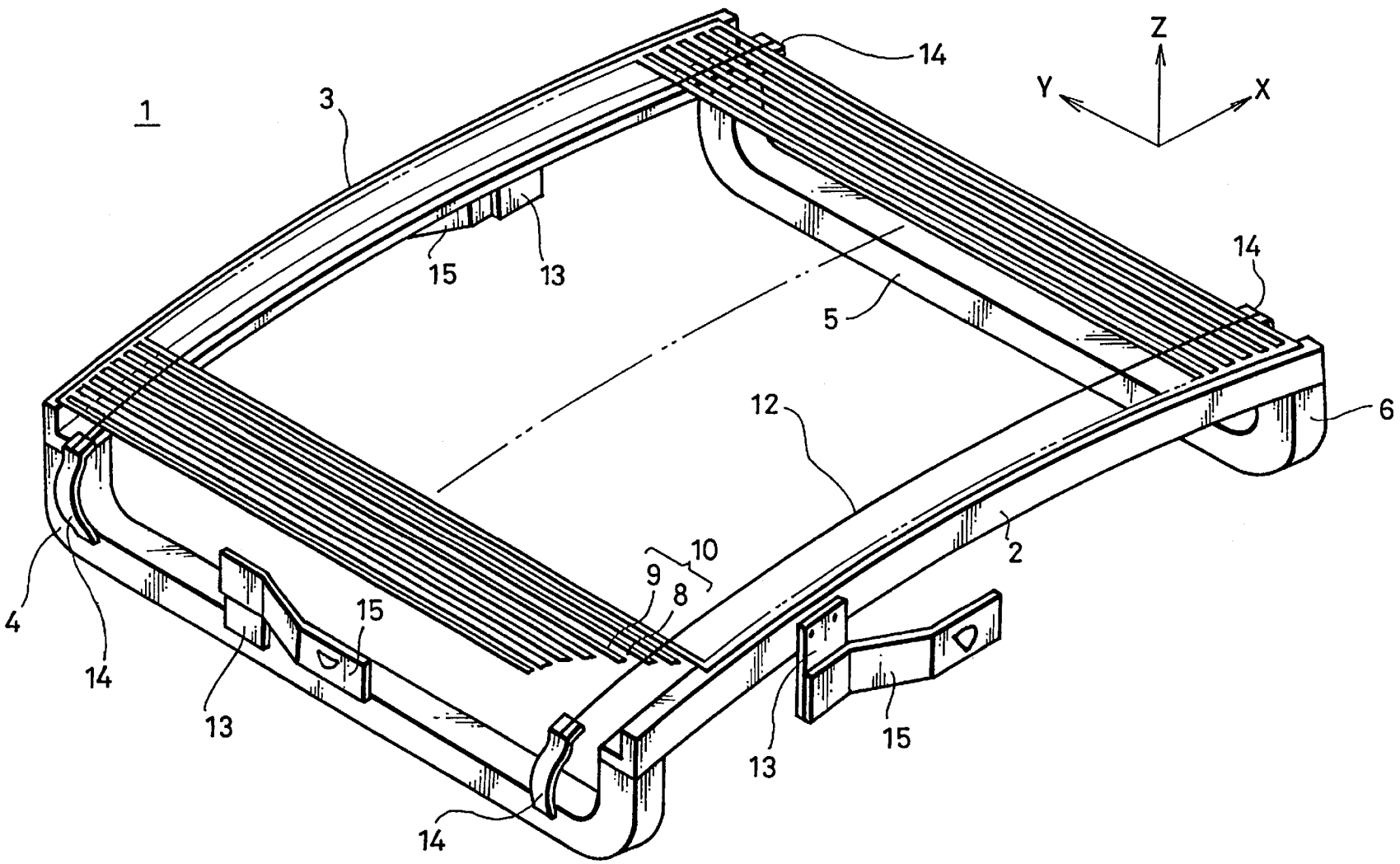
FIG. 3 is a perspective view showing an embodiment of a color selecting mechanism according to the present invention.
Figure 4:
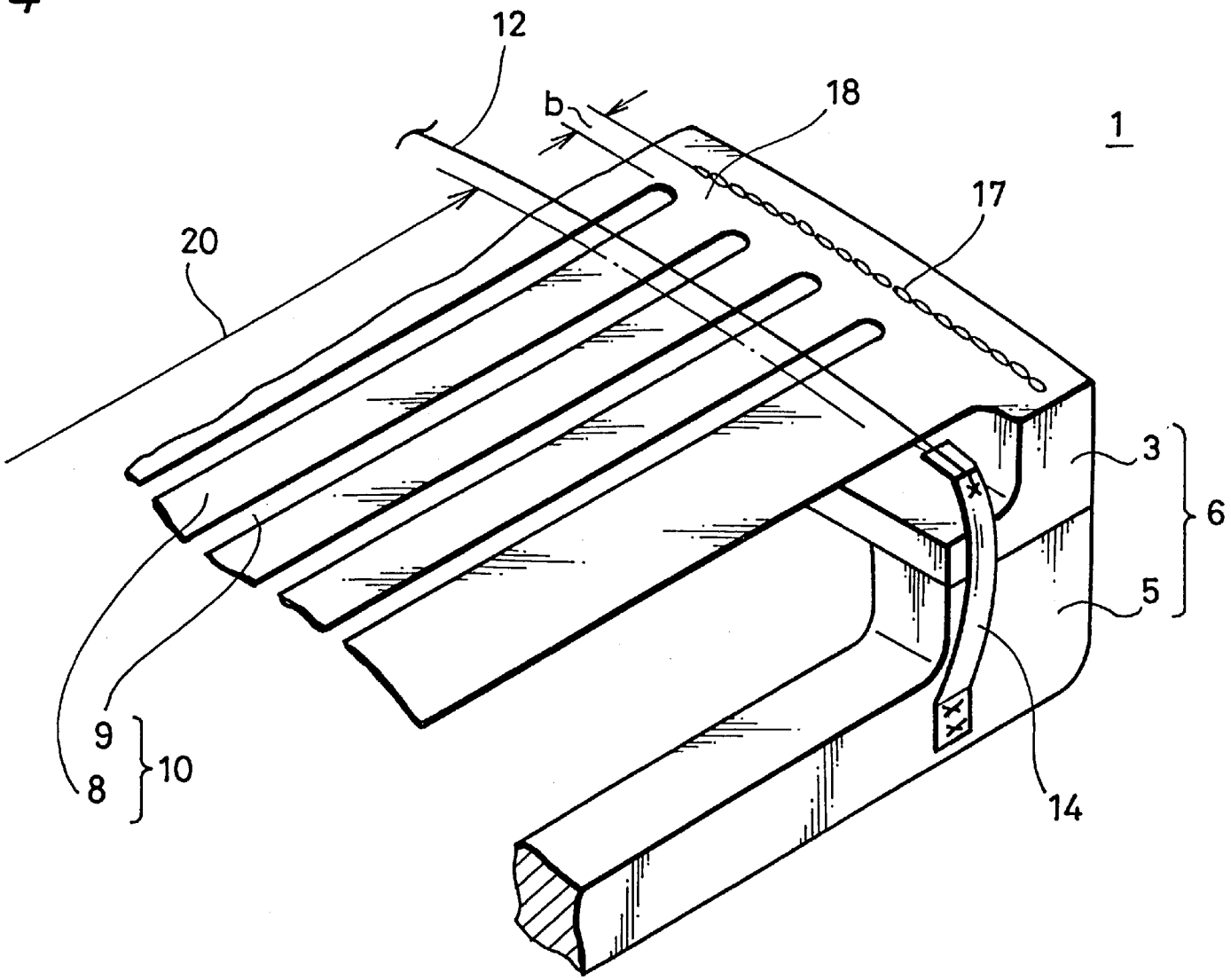
FIG. 4 is an enlarged view of an essential part of the color selecting mechanism according to the present invention.

A color selecting mechanism 1 according to the present invention, as shown in FIG. 3 and FIG. 4 (enlarged view of an essential portion thereof) is, similar to that mentioned before, formed such that there is provided a frame shaped metal frame 6 formed of a pair of opposing supporting members 2, 3 and elasticity applying members 4, 5 stretched between both end portions of the supporting members 2 and 3, and a mask member, that is, a color selecting electrode thin plate 10, in which arranged are a number of vertical slit shaped electron beam penetrating apertures 9 along one direction, that is, along a horizontal direction of a picture screen, is stretched between the opposing supporting members 2 and 3 of the frame 6.

The color selecting electrode thin plate 10 is formed of a thin metal plate in which a number of thin belt shaped grid elements 8 are arranged in the above mentioned one direction at a predetermined pitch and a slit shaped electron beam penetrating aperture 9 long in a vertical direction of the picture screen is formed between respective neighboring grid elements 8, and the grid elements 8 are stretched between the supporting members 2 and 3 by the elasticity applying members 4 and 5 with a predetermined tension.

The color selecting electrode thin plate 10 is fixed on the opposing supporting members 2 and 3 of the frame 6 by means of seam-welding. In FIG. 4, reference numeral 17 designates a seam-welded orbit and 18 denotes a space or so-called a periphery portion between an end portion of the electron beam penetrating aperture 9 and the seam-welded orbit 17, respectively.

In the above color selecting mechanism 1, a damper wire 12 is stretched in touch with a surface of the color selecting electrode thin plate 10 in order to prevent the grid element 8 from vibrating. The damper wire 12 is stretched through damper springs 14 respectively fixed onto the opposing elasticity applying members 4 and 5 of the frame 6.

Reference numeral 15 designates a supporting spring for fixing the color selecting mechanism 1 to a panel of a color cathode ray tube. The supporting spring 15 is welded on four sides of, for example, the supporting members 2, 3 and the elasticity applying members 4, 5 through a spring holder 13.

Figure 1:
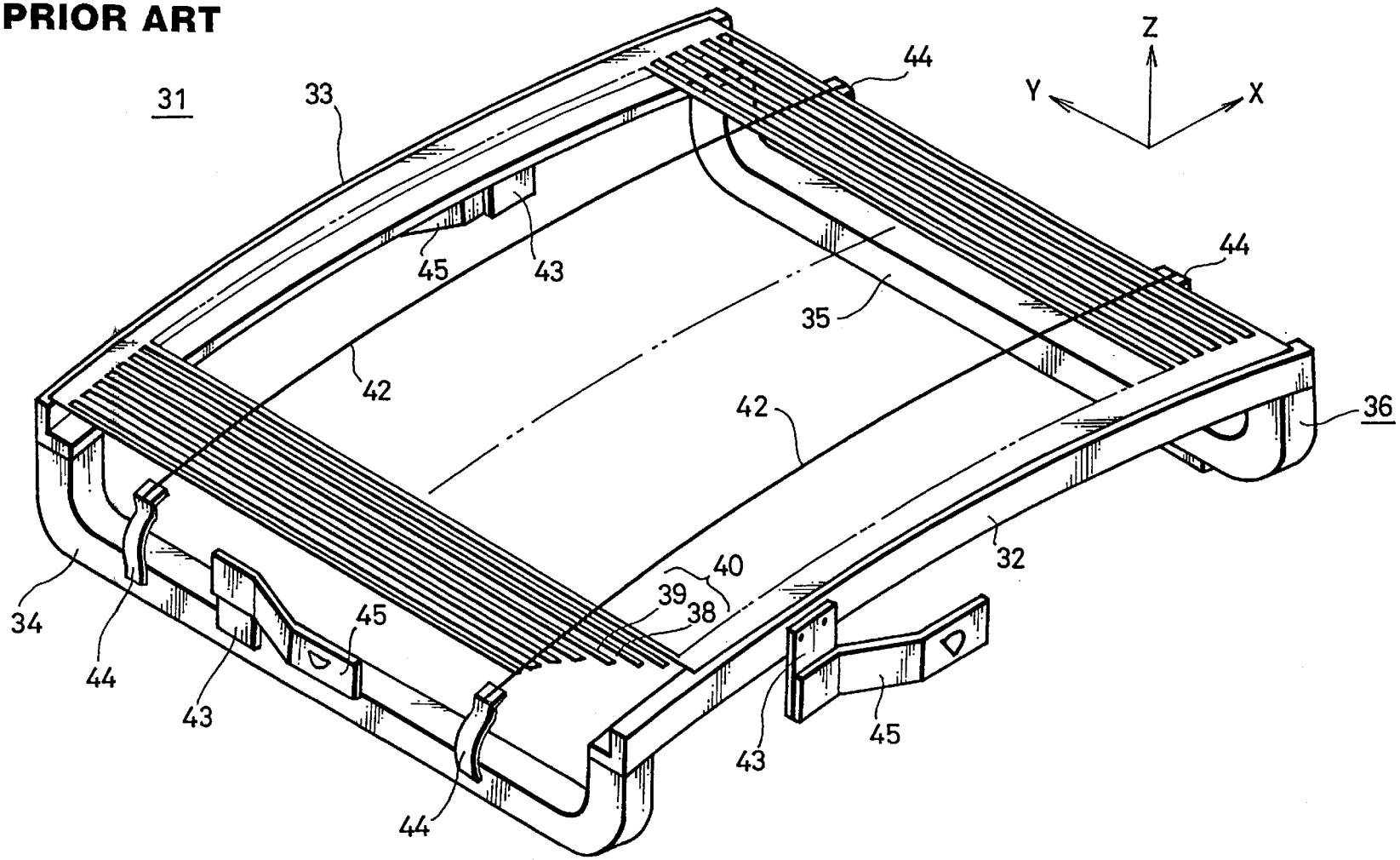
FIG. 1 PRIOR ART
FIG. 1 is a perspective view of a color selecting mechanism.
Figure 2:
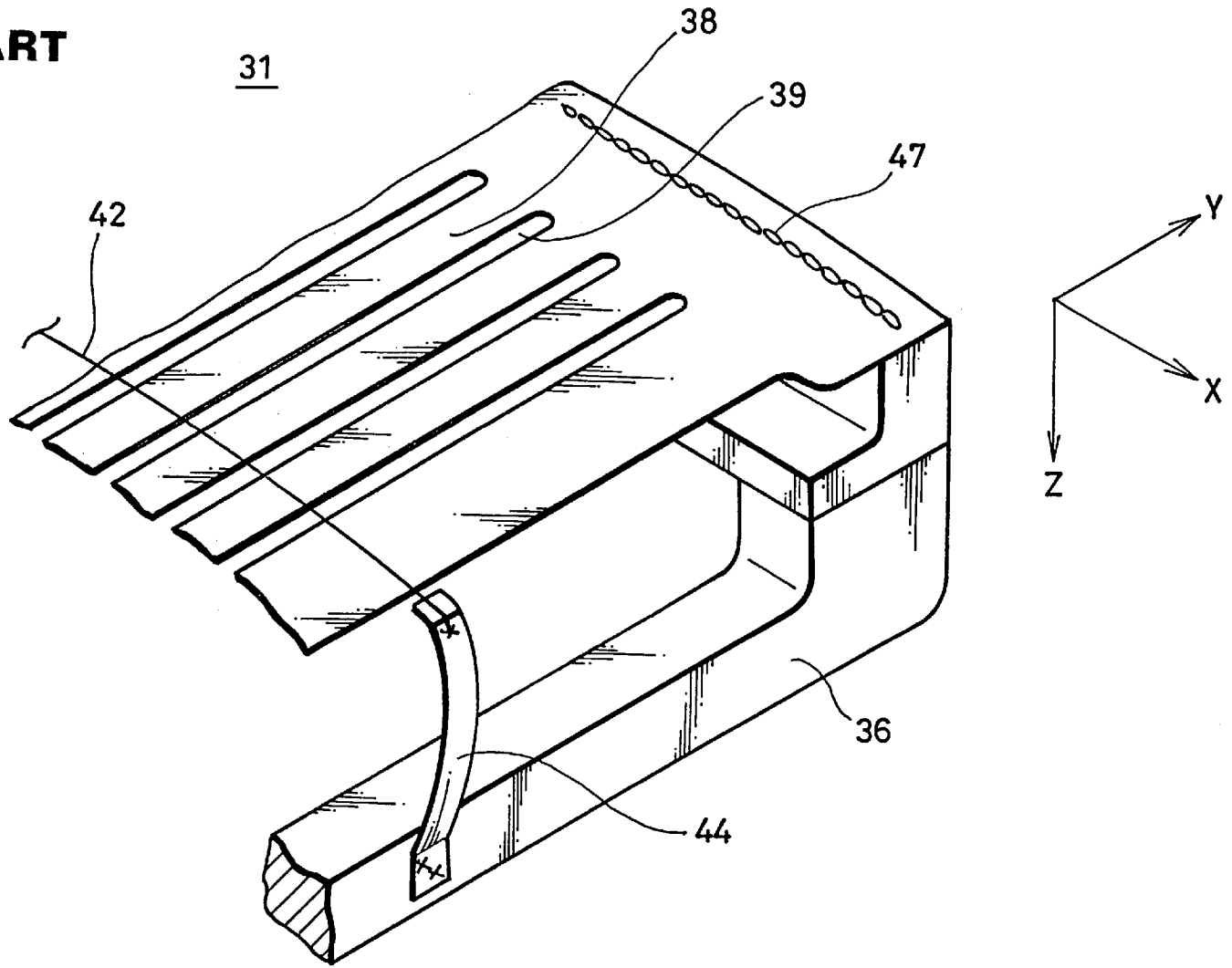
FIG. 2 PRIOR ART
FIG. 2 is an enlarged view of an essential part of the color selecting mechanism shown in FIG. 1.
Figure 5:
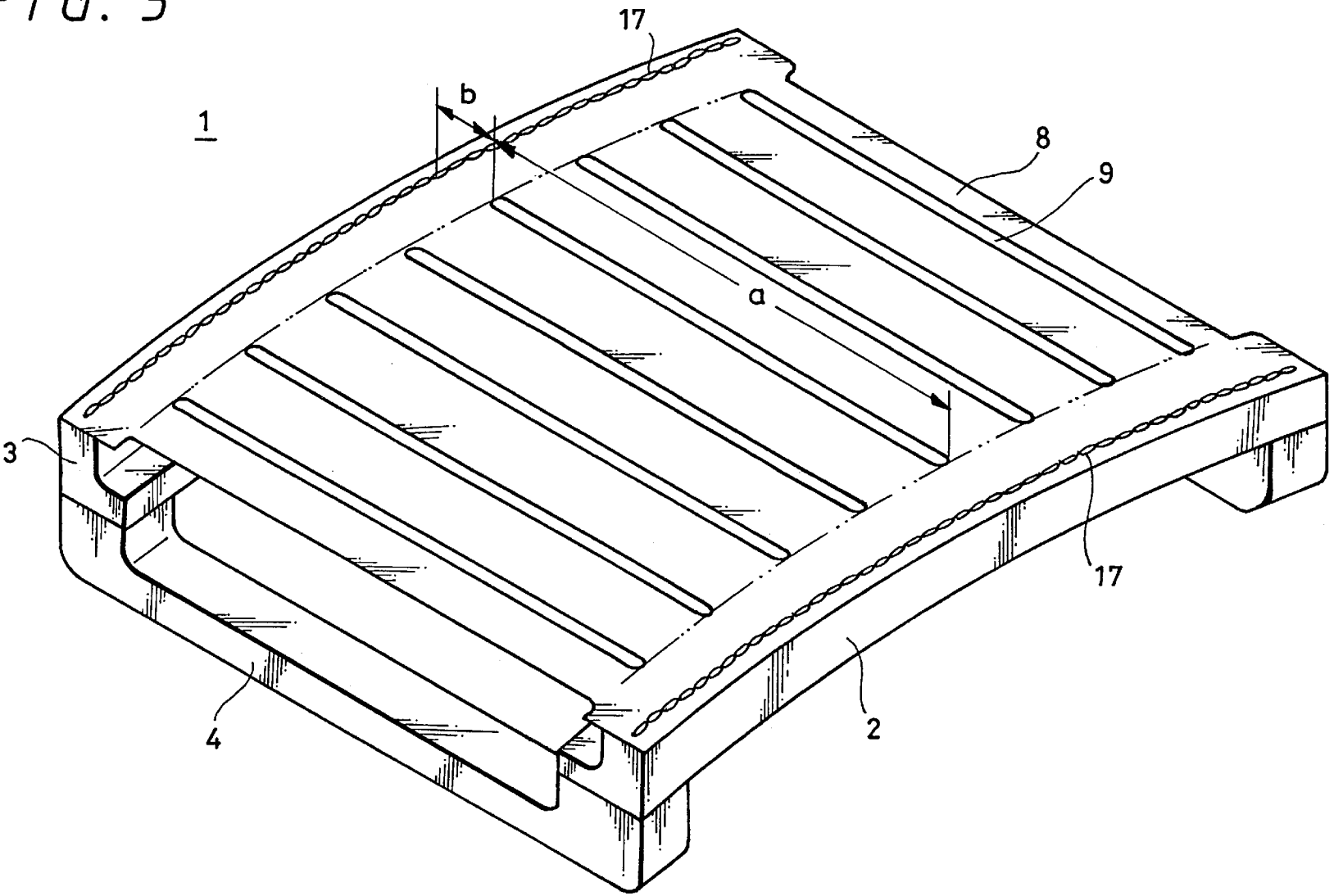
FIG. 5 is an explanatory diagram of a length a of an electron beam penetrating aperture and a width b of a periphery portion.

Particularly, the width of the periphery portion 18 is reduced so that, as shown in FIG. 5, a ratio of the length a of the slit shaped electron beam aperture 9 (corresponding to the length of the band shaped grid element 8) to a distance b to the seam-welded orbit 17 from an end portion of the electron beam penetrating aperture 9 (that is, the width of the periphery portion 18) or b/a×100 is set equal to or less than 2.5 percent. Besides, in this connection, the ratio of b/a×100 in the example shown in FIG. 1 is 3 through 5 percent.

As a means to reduce the width of the above mentioned periphery portion 18, there are, for example, the following two methods. One method is to reduce the dimension of the frame 6 in a vertical (y) direction (see FIG. 3). The other method is to elongate the electron beam penetrating aperture 9 of the color selecting electrode thin plate 10.

In the above mentioned latter method, that is, when the length of the electron beam penetrating aperture 9 is elongated, at a time of an exposure to light in manufacturing a fluorescent screen, it is necessary to mask an elongated portion of the electron beam penetrating aperture 9, so that a portion other than the effective picture screen is not exposed to the light. At a time of structuring the color selecting mechanism 1 by the latter method, as shown in FIG. 4, the damper wire 12 is made to be installed outside an effective screen area 20 of the color selecting electrode thin plate 10.

Besides, in the former method, that is, when the dimension of the frame 6 in the vertical (Y) direction is reduced to structure the color selecting mechanism 1, by deforming the shape of the spring holder 13 outwardly, it is possible to support the color selecting mechanism 1 within the panel of the color cathode ray tube in the same way as usual.

According to the above mentioned color selecting mechanism 1, by setting the ratio of the length a of the slit shaped electron beam penetrating aperture to the distance b to the electron beam-welded orbit 17 (the width of the periphery portion 18), that is, b/a×100 equal to or less than 2.5 percent which is smaller than the prior art, it is possible to suppress the vibration of the grid element at the central portion which is difficult to be attenuated in a case of being applied with a vibration. Therefore, a uniformity deterioration (change in brightness) caused by the vibration can be avoided.

Also, as shown in FIG. 4, when the length of the electron beam penetrating aperture 9 is elongated and the damper wire 12 for preventing the vibration is provided on the outside of the effective picture screen area 20, the damper wires on the effective picture screen area 20 become unnecessary, and hence a picture screen without a damper shadow can be obtained. Therefore, the color selecting mechanism 1 according to the present invention is made to be suited for being applied to a high definition tube, a double speed television receiver and the like.

According to the color selecting mechanism for the color cathode ray tube of the present invention, the vibration of the grid element corresponding to a central portion of a picture screen can be improved much and there scarcely occurs any change of brightness to a color picture due to the uniformity deterioration. Also, when the damper wire for preventing the grid element of the color selecting mechanism from vibrating is provided outside the effective picture screen area, there is no occurrence of the damper shadow on the picture screen. Therefore, a color picture of very high quality can be obtained.

Having described a preferred embodiment of the present invention with reference to the accompanying drawings, it is to be understood that the present invention is not limited to the above-mentioned embodiment and that various changes and modifications can be effected therein by one skilled in the art without departing from the spirit or scope of the present invention as defined in the appended claims.

What is claimed is:

1. A color selecting mechanism for a color cathode ray tube, in which a color selecting electrode thin plate having a number of band shaped grid elements and a slit shaped electron beam penetrating aperture formed between respective neighboring grid elements is seam-welded on a frame, wherein a ratio of a length a of said slit shaped electron beam aperture to a distance b to a seam-welded orbit from an end portion of said electron beam penetrating aperture or b/a×100 is set equal to or less than 2.5 percent.

2. A color selecting mechanism for a color cathode-ray tube according to claim 1, wherein a damper wire is provided outside an effective picture screen area of said color selecting electrode thin plate.

* * * * *